United States Patent [19]

Vandas

[11] 4,022,118

[45] May 10, 1977

[54] KITCHEN VENTILATOR GREASE EXTRACTOR CONSTRUCTION

[75] Inventor: Edward B. Vandas, St. Louis, Mo.

[73] Assignee: McGraw-Edison Company, Elgin, Ill.

[22] Filed: Apr. 12, 1976

[21] Appl. No.: 675,965

[52] U.S. Cl. ..... 98/115 K; 55/DIG. 36; 126/299 A; 126/299 B

[51] Int. Cl.[2] ..... F23J 11/12

[58] Field of Search ..... 98/115 K, 115 R; 126/299 R, 299 A, 299 B, 299 C; 55/DIG. 36

[56] References Cited

UNITED STATES PATENTS

| | | | |
|---|---|---|---|
| 3,207,058 | 9/1965 | Gaylord | 98/115 K |
| 3,490,206 | 1/1970 | Doanne | 98/115 K X |
| 3,786,739 | 1/1974 | Wright | 98/115 X |

*Primary Examiner*—Ronald C. Capossela
*Attorney, Agent, or Firm*—Charles F. Lind

[57] ABSTRACT

This invention relates to a ventilating system used for withdrawing cooking fumes from a kitchen, teaching an improved fire rated centrifugal grease extractor and flow control damper arrangement at the inlet to the extractor.

The disclosed centrifugal grease extractor structure defines a tortuous airflow path between the inlet opening from the kitchen and the exhaust duct that leads to the outside atmosphere. This tortuous path defining extractor structure includes downwardly pitched bottom and top walls and interconnected vertical side walls and a vertical rear wall, and upwardly and downwardly depending baffles formed from these walls and by the flow control damper when opened. The structure further includes a projection that upstands from the bottom wall opposite the one downwardly disposed baffle, and another projection from the rear wall that extends toward and opposes the lower most end of this same baffle; whereby the separated throat areas are defined therebetween that improve the centrifugal extraction effect at these areas, and further whereby the projections preclude or minimize the migration of collected grease droplets past these areas. High pressure spray wash mechanism further is disclosed for cleaning grease from the surfaces of the tortuous path defining structure.

7 Claims, 4 Drawing Figures

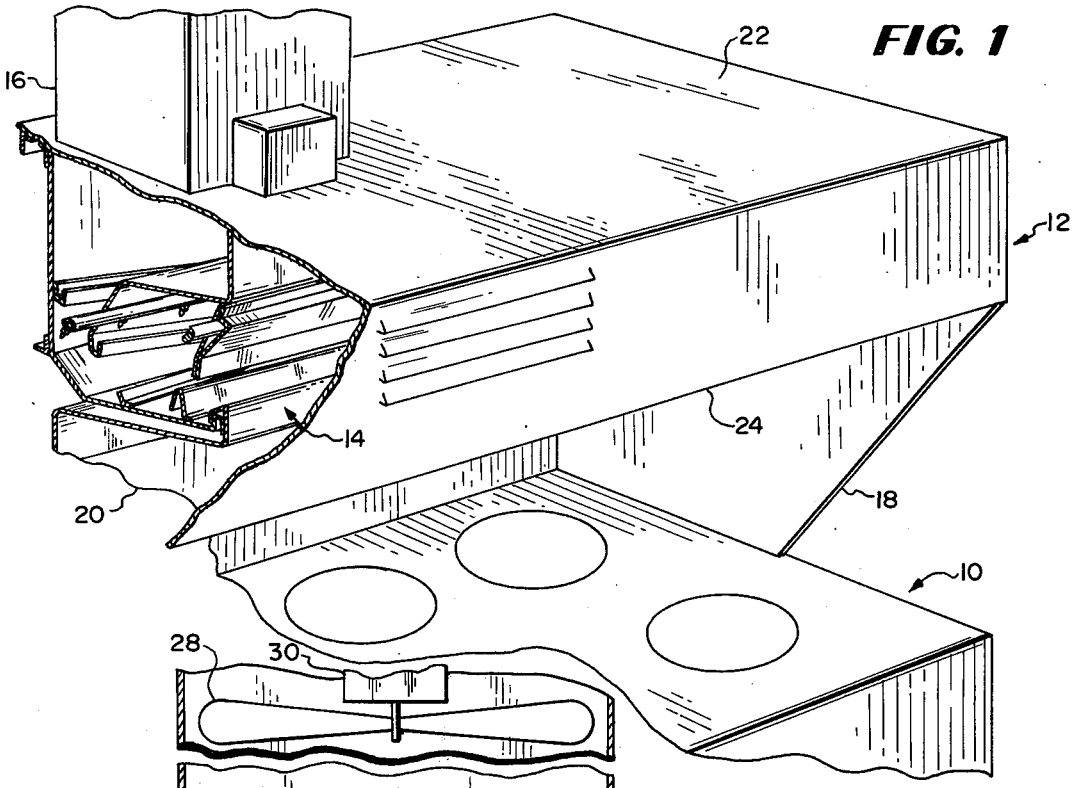
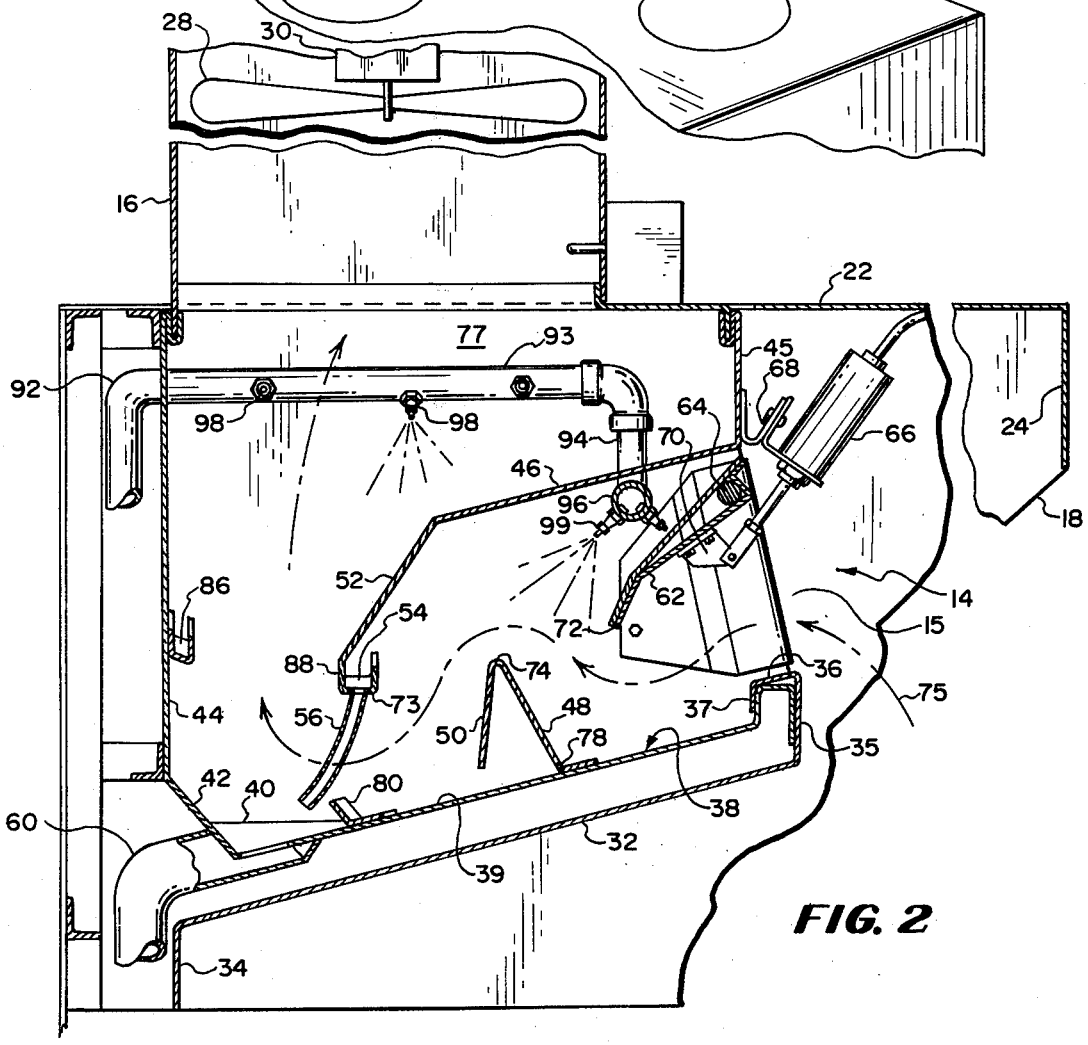
FIG. 2

FIG. 3
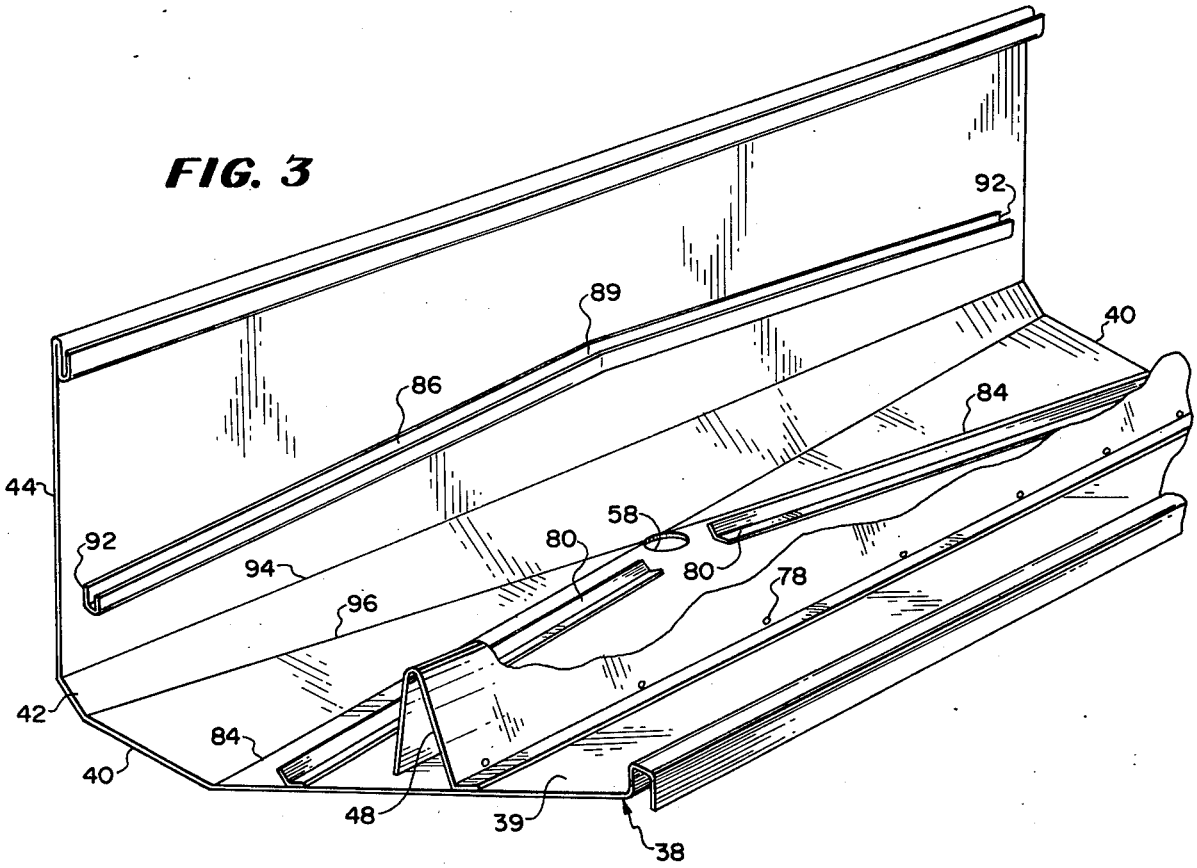
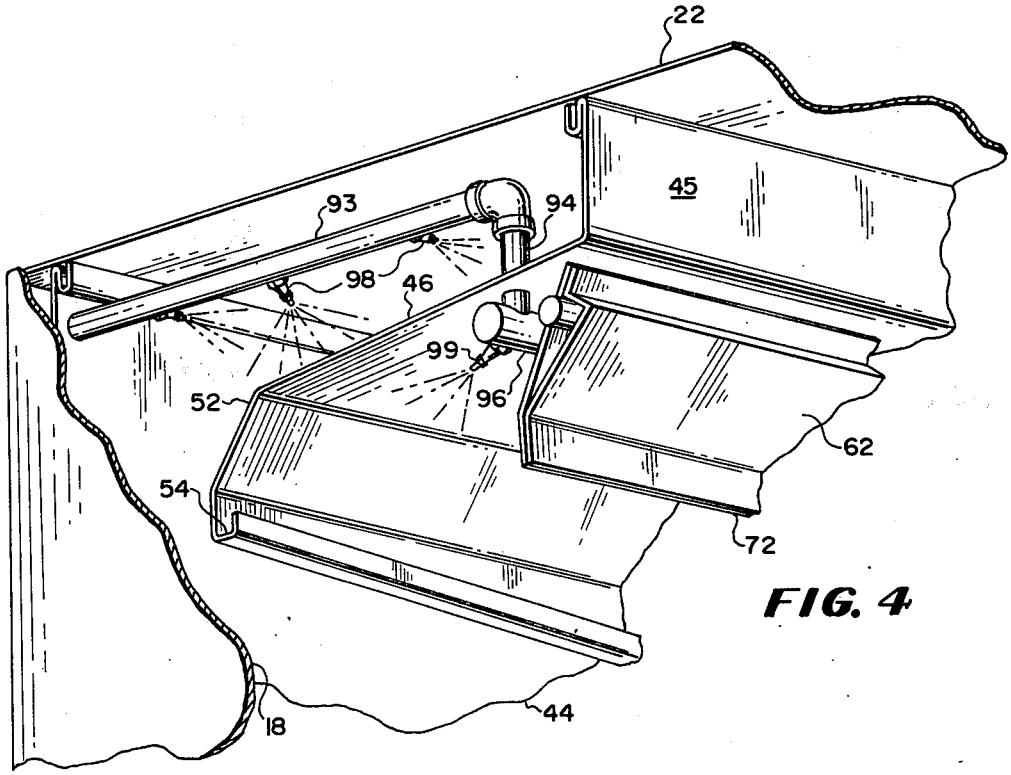
FIG. 4

KITCHEN VENTILATOR GREASE EXTRACTOR CONSTRUCTION

BACKGROUND OF THE INVENTION

In kitchens for restaurants or other institutional feeding places, creature comfort plus local safety codes frequently call for venting system for positive removal of the cooking fumes for discharge to atmosphere outside the kitchen. Because of the generation in these fumes of vaporous grease, it is further generally required to filter or extract the grease from the vented air before discharging it to atmosphere. Two basic types of grease extraction systems are employed, the filtering system and the centrifical flow system.

The filtering system requires that the vented air pass through very finely meshed media that allows through passage of only particles smaller than the mesh openings of the media. Droplets of grease, typically having a larger micron diameter than the media flow paths, are thus removed from the airstream and collected on the media. The problem with these filters is that increased back pressure is generated as the filters become dirty, thereby decreasing the volume of the vented air below that actually needed or desired. Further, the filters have to be cleaned or replaced on a very regular basis, or they become grease entrained so as to create a fire hazard.

The centrifugal flow system relies soley on creating a tortuous path for the vented air to follow, so that each time the air is forced to bend the heavier droplets of grease are thrown against the wall defining the tortuous path and thereby removed from the airstream. The grease droplets generally accumulate in sufficient volumes that most of that collected can be drained along pitched walls and be discharged to a collector. However, a problem again exists in the system in that the surfaces must be periodically cleaned to prevent a fire hazard as well as keep the back pressure against flow within specific limits. In some designs, small separate louver elements are used to create the tortuous flow paths and these must be removed from the vent structure and be washed by hand . . . a potentially haphazard or unreliable, time consuming, and costly procedure. In certain other designs, the vent structure itself defines the extractor, and internally located nozzles can discharge hot water and detergent to remove the bulk of the grease off the surfaces of the vent walls; but known systems provide incomplete wash coverage. Further, unitary vent extractor arrangements of this type typically must have a damper that can be shifted to block off the flow path in case of a fire, and incomplete wash coverage can allow such grease buildup to preclude or hinder the closing operation of the damper.

Several patents which relate to the ventilation apparatus over which the disclosure forms an improvement are the Gaylord U.S. Pat. No. 2,813,477 entitled Safety Ventilator Unit; the Graswich et al. U.S. Pat. No. 2,961,941 entitled Grease Extracting Attachment for Ventilators for Kitchen Ranges; the Gaylord U.S. Pat. No. 3,055,285 entitled Kitchen Ventilating System; the Gaylord U.S. Pat. No. 3,207,058 entitled Kitchen Ventilating System; the Gaylord U.S. Pat. No. 3,247,776 entitled Kitchen Ventilating System; the Gaylord U.S. Pat. No. 3,611,909 entitled Fail-Safe Damper Control for Kitchen Ventilator; and the Gaylord U.S. Pat. No. 3,785,124 entitled Pollution-Free Kitchen Ventilator.

SUMMARY OF THE INVENTION

The disclosed centrifugal extractor defines a tortuous airflow path between an inlet opening from the kitchen to an exhaust duct that discharges vented air to atmosphere outside the kitchen. The flow path is defined between inclined top and bottom walls and vertical interconnecting side walls, where the opened inlet damper and specific baffles or projections from these walls force the airflow downwardly and upwardly several times until following a rear wall upwardly to the exhaust duct. The bottom wall is pitched downwardly at approximately 10° to 20° from the horizontal and rearwardly away from the inlet and the damper hinged adjacent the top wall just rearwardly of the inlet forces the flow path downwardly and around the lower end of the damper. A first baffle upstands from the bottom wall approximately midway between the inlet and the rear wall and forces the flow path upwardly toward the top wall. A second baffle depends downwardly from the top wall at a location approximately midway between the first baffle and the rear wall and forces the airflow path downwardly again toward the bottom wall. A first small projection pitched upwardly and rearwardly from the bottom wall at a location generally underlying this second baffle redirects the airflow path upwardly toward the rear wall, and a second small projection projects forwardly from the rear wall at a location generally opposite to and horizontally spaced from the lower end of this same second baffle. These latter mentioned small projections constrict the flow paths at these locations near the bottom wall–rear wall corner, and further inhibits the migration of collected grease droplets past the projection. The lower ends of the opened damper and of the second damper define a plane which generally parallels the bottom wall and further which extends approximately midway through the inlet; and the top of the first lower baffle extends upwardly only approximately to this plane.

Additionally, first discharge nozzles located adjacent the top wall and slightly rearwardly of the opened damper discharge the cleaning solution in a direction generally downstream of the airflow to impinge directly against both the first and second baffles and against the bottom wall, and secondarily against the damper so as to wash them, and second nozzles located adjacent the opposed side walls near the inlet to the exhaust duct discharge the cleaning solution crosswise to the airflow to impinge against the opposite side wall, the rear wall, and the top side of the second baffle. These spray means provide full coverage for washing the grease from the extractor wall.

BRIEF DESCRIPTION OF THE DRAWINGS

FIG. 1 is a perspective view of a typical arrangement of a kitchen cooking appliance and overlying vent hood, illustrating therein a preferred embodiment of the disclosed grease extractor;

FIG. 2 is a cross-sectional view, enlarged as compared to that shown in FIG. 1, showing the principal extractor, damper, and washing components;

FIG. 3 is a perspective view, looking downwardly, of the inside of the grease extractor, with the top baffle wall being removed for clarity of the disclosure, showing significant components of the disclosed extractor; and FIG. 4 is a perspective view, looking upwardly and generally from adjacent an end wall, showing the significant components of the disclosed extractor that had been removed from FIG. 3.

DETAILED DESCRIPTION OF THE INVENTION

In FIG. 1, there is illustrated a cooking range 10 of the type as might be used in a commercial kitchen, and an overlying vent hood 12 having a grease extractor section 14 therein which forms a part of this invention. The extractor section has structure that defines an inlet opening 15 from the kitchen and an airflow path to an exhaust duct 16 that extends through building structure (not shown) for discharge to the atmosphere outside of the kitchen.

The hood 12 typically includes opposed vertical side walls 18 (only one of which is shown), vertical rear wall 20, a horizontal top wall 22, and typically there further is a front wall 24 that downwardly depends from the top wall. The hood thus defines an inverted cup-like structure that readily collects the fumes rising from the underlying appliance 10. The extract section 14 actually is small relative to the hood and is located in the disclosed arrangement only at the upper rear corner thereof, although other locations would be possible as the different applications might dictate.

Further, a fan or blower 28 is located in the airflow path, and although generally it might be located in a housing on the building roof or in an opening in the building wall, the same is shown schematically in the duct 16. The blower or fan 28 is powered in a conventional manner by motor 30 and serves to draw kitchen air through the extractor 14 for discharge out the exhaust duct 16 to atmosphere.

As illustrated, the extractor 14 extends between the hood side walls 18 and thus is the full width of the hood. The extractor section has an outer bottom wall 32 that extends forwardly of rear panel 34 to lower vertical front panel 35, which in turn is bent rearwardly and downwardly to form lower inlet panel 36 and front lip panel 37. A bottom wall 38 underlies this lip configuration and (see FIGS. 2 and 3) extends rearwardly therefrom along panel 39 in a downwardly pitched inclination approximately between 10° and 20° from the horizontal, and across pitched corner panels 40 and 42 to vertical rear wall 44.

An upper front wall 45 depends downwardly from top wall 22 to rearwardly directed upper inlet panel 46, where the place between the lip structure panel 36 and the panel 46 comprises the inlet opening 15 to the extractor section. Approximately midway between the front lip 39 and the rear wall 44, there is an upstanding intermediate lower baffle 48 that extends entirely across the extractor section and further that has a downwardly and rearwardly disposed rear panel 50 that terminates spaced above the lower wall 38. The upper inlet panel 46 is bent downwardly at baffle panel 52, and further an upturned trough 54 extended across the full extractor width is formed at the lower end of the baffle panel 52. The trough 54 is pitched with its highest points adjacent the side walls and its lowest point generally at the middle of the extractor section. A drain tube 56 is secured to the trough over an opening formed in the trough to allow the drain-off of any collected liquids from the trough out the tube to the bottom wall 38.

In this regard, there is in the bottom wall at the lowest common meeting of the pitched panels 39, 40, and 42 a drain opening 58 which communicates through pipe 60 to a suitable sewage connection or waste pipe (not shown) for conveying the grease and wash liquid, as will be noted, away from the unit.

There further is provided a damper 62 pivoted at mounting pins 64 relative to the side walls 18 of the extractor and which in the opened position as shown allows flow of air through the inlet 15 and extractor and out the exhaust duct 16. The damper further can be shifted to a closed position across the inlet to preclude free transfer of kitchen air through the inlet and into the extractor section and out the exhaust duct. A power actuating device 66 secured between a bracket 68 supported on upper front panel 45 and a yoke-bracket arrangement 70 on the damper itself operates to shift the damper between the operative positions.

The pivotal mounting of the damper is disclosed in detail in my copending application filed Dec. 8, 1975, and having Ser. No. 638,502, with a title of KITCHEN VENTILATOR DAMPER CONSTRUCTION; and the particular actuating device and control for shifting the damper between its two operative positions is disclosed in detail in my copending application entitled KITCHEN VENTILATOR DAMPER ACTUATOR AND CONTROL which was filed on Apr. 8, 1976 and has Ser. No. 674,816.

As noted, the damper 62 is pivoted about mounting pins 64 at the upper portion of inlet 15 so that in the open position (as illustrated in FIG. 2) the damper is pitched rearwardly and downwardly. The lower end 72 of the damper further then lines up generally with the lower edge 73 of the upper baffle when a plane is extended through such low points that parallels the main panel 39 of the bottom wall 38; and the upper wall panel 46 is parallel to this plane also. Further, this plane extends approximately through the midpoint heightwise of the inlet opening 15. The upper end 74 of the intermediate baffle 48 line up approximately with or is at most spaced only slightly beyond this plane, and further is approximately front to rear midway between the spaced low points 72 and 73 respectively of the damper and of the baffle.

Consequently, flow of air through the extractor section as thus far defined is indicated by the arrowed line 75, and is horizontally through the opening 15, and then downwardly around the lower edge 72 of the damper toward the bottom wall 38 and the lower baffle 48, and then upwardly over the pitched bottom baffle 48 toward the top wall panels 46 and 52, and then downwardly past and around the upper baffle trough section 54 toward the bottom wall panels 39, 40, and 42 and rear wall 44, and upwardly along the rear wall, and then through the enlarged plenum section 77 to the exhaust duct 15. The plenum section 77 is defined by and between the side walls 18, the rear wall 44, the upper baffle walls 46 and 52, the upper front wall 45, and the top wall 22 and extends the full width of the extractor to allow lateral movement of the air to the centrally located exhaust duct 16 for discharge from the duct.

This tortuous airflow path throws the entrained grease particles in the airstream against the lower baffle 48, against the upper baffle 52, against the bottom wall panels 39, 40, and 42 and against the rear wall 44; while the lighter air particles flow generally uninhibited along the medial portion of the defined passage. The grease deposited on these walls drains because of the pitch of each, as noted, to the drain opening 58 in the bottom wall. The baffle 48 has small openings 78 drilled or otherwise fabricated therein at spaced locations along the bottom wall to allow liquid collected along the bottom wall upstream of the baffle to drain through the openings and follow the pitched bottom wall 38 to the drain 58; while liquid collected in the upper trough 54 drains through the tube 56 as noted to the lower drain opening 58.

Significant to the subject invention is the formation of a small upstanding bottom wall projection or fin 80 that extends almost the full width of the trough section from the side walls inwardly towards the center; but a medial gap exists in the fin to leave a pathway for the grease collected along the bottom wall 38 to drain to the opening 58. Actually, two separate fin pieces are used and are secured to the bottom wall panel 39 just upstream of and generally parallel to the crease line 84 formed between the panel 39 and the pitched triangular panels 40. These pitches each fin downwardly from adjacent the side walls to its low point adjacent the drain opening 58. The fin thus tends to preclude the free travel of the collected grease along the bottom wall, and it further drains it right to the drain opening 58.

The fin is generally opposite to and vertically aligned beneath the lower edge 73 of the upper baffle 52, and is pitched upward and rearward, tending thereby to redirect the airflow upwardly away from the lower rear corner section of the extractor where liquid tends to accumulate. This minimizes airstream interaction with this liquid and reduces the tendency to push this liquid vertically up the back wall 44 to and out the exhaust duct. The fin also creates a restricted throat section beneath the lower baffle edge 73, to induce a high velocity airstream just where the flow path is forced to bend vertically.

The fin thus appears to significantly improve the efficiency of the extractor in removing grease from the vented air.

Significant also to the subject invention is the provisions of a trough 86 formed on the rear wall 40. The rear trough in fact presents a projection forwardly of the rear wall, generally opposite to and only slightly higher vertically than the rearward most edge 88 of the upper baffle 52. This again redirects the flow path away from the rear wall and further creates a restricted throat area to induce localized high velocity airflow that centrifugally throws the heavier grease droplets against the under side of the projection. The under side of the projection is pitched downwardly in a forward direction away from the rear wall in order to prevent or minimize the vertical migration up the rear wall of the droplets collected thereon.

The top side of the trough 86 is pitched from its high 89 at the center of the extractor to its low adjacent the side edges 92 thereof, which edges terminate spaces from the extractor section side walls to allow liquid draining from the trough to fall freely onto the bottom wall 38.

The bottom wall panel 42, as noted, is pitched in a downward and forward inclination from the crease line 94 with the rear wall 44 to crease line 96 with panels 40 and to the drain opening 50.

Also significant in the subject invention is the means for washing the grease and dirt buildup from the extractor section walls, and this includes the area of the plenum 77 and the airflow passage itself. Specifically, high-pressure water lines 92 preferably enters the plenum 77 at the rear wall 44 thereof, and extend forwardly at sections 93 closely adjacent each side wall to overlying relationship just rearwardly of where the damper is located, then are directed downwardly as sections 94 through the upper wall 46 of the extractor section, and again extend crosswise at common section 96 with the extractor section just rearwardly of the damper. Nozzles 98 are located at spaced locations along the horizontal sections 93 of each line and discharge horizontally within the plenum to impinge against the opposite side wall and further against the top of the baffle walls 46 and 52 and against the rear wall 44. Additionally, nozzles 99 located at spaced locations along the horizontal section 96 of the line discharge downwardly against the intermediate baffle 48, against the rearwardly disposed baffle 52 including the open trough section 54, against the bottom wall 38, and against the inside face of the damper 62. By proper use of hot water and a detergent solution, it is generally possible to wash most buildup and impurities from the surfaces for flushing down the drain opening 58 as noted above.

During the wash cycle of the extractor when water is being discharged from the various spray nozzles, the damper 62 is closed and the blower or fan 28 is inoperative. Also, since the source of the wash water is typically the same as that used in the building generally, the pressures for the spray are generally in the range of 40–80 psig.

I claim:

1. In a kitchen venting system having an exhaust duct and power fan means therein for discharging kitchen fumes to atmosphere outside the kitchen, the combination of improved grease extraction means in series air flow connection with the exhaust duct, comprising opposing bottom and top walls and spaced interconnecting side walls therebetween defining a vertically disposed inlet open to the kitchen, said bottom wall being pitched downwardly at approximately 10° – 20° from the horizontal and rearwardly away from said inlet and a rear wall upstanding vertically from the rear end of the bottom wall, a drain in the bottom wall adjacent the rear wall, a first baffle upstanding from the bottom wall approximately midway between the inlet and the rear wall, a second baffle downstanding from the top wall approximately midway between the first baffle and the rear wall, a damper hinged adjacent the top wall for movement between a closed position across the inlet and an opened position angled downwardly and rearwardly from the top wall, the lower end of the opened damper being approximately midway between the inlet and the first baffle and further the lower ends of the opened damper and the second baffle defining a plane extended generally parallel to the bottom wall and approximately midway through the inlet and wherein the first baffle extends at least to but at most only slightly beyond said plane, whereby a tortuous flow path is defined rearwardly from the inlet having up and down girations until being directed vertically upwardly along the rear wall for discharge through the exhaust duct, and a fin upstanding from the bottom wall at a location generally vertically below the second baffle, thereby constructing the flow path at this location and further directing liquid droplets of collected grease toward the drain.

2. A kitchen venting system combination according to claim 1, further including a trough projecting forwardly from the rear wall at a location generally opposite and horizontally spaced from the second baffle, thereby constricting the flow path at this location and further terminating upward travel along the rear wall of liquid droplets of collected grease.

3. A kitchen venting system combination according to claim 2, further including a trough formed at the lower end of the second baffle and being upwardly open in the direction upstream of the flow path, and tube means draining the trough for discharge adjacent the bottom wall in the general vicinity of the drain.

4. In a kitchen venting system having an exhaust duct and power fan means therein for discharging kitchen fumes to atmosphere outside the kitchen, the combination of improved grease extraction means in series air flow connection with the exhaust duct, comprising opposing bottom and top walls and spaced interconnecting side walls therebetween defining a vertically disposed inlet open to the kitchen, said bottom wall being pitched downwardly at approximately 10° – 20° from the horizontal and rearwardly away from said inlet and a rear wall upstanding vertically from the rear end of the bottom wall, a drain in the bottom wall adjacent the rear wall, a first baffle upstanding from the bottom wall approximately midway between the inlet and the rear wall, a second baffle downstanding from the top wall approximately midway between the first baffle and the rear wall, a damper hinged adjacent the top wall for movement between a closed position across the inlet and an opened position angled downwardly and rearwardly from the top wall, the lower end of the opened damper being approximately midway between the inlet and the first baffle and further the lower ends of the opened damper and the second baffle defining a plane extended generally parallel to the bottom wall and approximately midway through the inlet and wherein the first baffle extends at least to but at most only slightly beyond said plane, whereby a tortuous flow path is defined rearwardly from the inlet having up and down girations until being directed vertically upwardly along the rear wall for discharge through the exhaust duct, a trough formed at the lower end of the second baffle and being upwardly open in the direction upstream of the flow path, and further including tube means draining the trough for discharge adjacent the bottom wall in the general vicinity of the drain.

5. A kitchen venting system combination according to claim 4, further including spray means transversely across the flow path in proximity of the top wall and rearward of the opened damper and adapted to discharge a cleaning fluid in the direction generally downstream of the flow path and generally in the direction of the opened damper to impinge against the first baffle, second baffle, and bottom wall for washing same.

6. A kitchen venting system combination according to claim 5, further including second spray means disposed adjacent the side walls at location above the second baffle operable to discharge a cleaning fluid in a direction generally crosswise to the direction of flow and generally toward the opposite side walls.

7. A kitchen venting system combination according to claim 5, further including a trough projecting forwardly from the rear wall at a location generally opposite and horizontally spaced from the second baffle, thereby constricting the flow path at this location and further terminating upward travel along the rear wall of liquid droplets of collected grease, and second spray means disposed adjacent the side walls at location above the second baffle and trough on the rear wall operable to discharge a cleaning fluid in a direction generally crosswise to the direction of flow toward the opposite side walls and toward the rear wall trough for washing same.

* * * * *